US007825316B2

(12) United States Patent
Stagg

(10) Patent No.: US 7,825,316 B2
(45) Date of Patent: Nov. 2, 2010

(54) GUITAR BODY SHAPE CONVERTER

(76) Inventor: Alan Stagg, 22 Bartman Rd., East Brunswick, NJ (US) 08816

( * ) Notice: Subject to any disclaimer, the term of this patent is extended or adjusted under 35 U.S.C. 154(b) by 0 days.

(21) Appl. No.: 12/541,125

(22) Filed: Aug. 13, 2009

(65) Prior Publication Data

US 2010/0043620 A1 Feb. 25, 2010

Related U.S. Application Data

(60) Provisional application No. 61/089,935, filed on Aug. 19, 2008.

(51) Int. Cl.
*G10D 3/00* (2006.01)

(52) U.S. Cl. ..... 84/327

(58) Field of Classification Search ..... 84/327, 84/329, 453

See application file for complete search history.

(56) References Cited

U.S. PATENT DOCUMENTS

| | | | | |
|---|---|---|---|---|
| 4,339,981 | A | 7/1982 | Smith | |
| 4,538,497 | A | 9/1985 | Smith | |
| 6,172,292 | B1 * | 1/2001 | Dimbath | 84/453 |
| 7,002,065 | B2 | 2/2006 | Petersen | |
| 2005/0257664 | A1 * | 11/2005 | Kessler | 84/453 |

* cited by examiner

*Primary Examiner*—Kimberly R Lockett
(74) *Attorney, Agent, or Firm*—Lawrence C. Edelman, Esq.

(57) ABSTRACT

A body adapter for a stringed musical instrument, comprising: a bottom portion and a varying thickness perimeter sidewall portion, where a space bounded by the bottom portion and an inside portion of the perimeter sidewall portion, forms a receiving compartment. The receiving compartment has a shape adapted to releasably receive the body of a stringed musical instrument and thereby change the shape of the instrument as it is held by a user for playing, from that of the outside shape of the musical instrument, to the outside shape of the body adapter.

6 Claims, 7 Drawing Sheets

GUITAR BODY SHAPE CONVERTER

CROSS-REFERENCE TO RELATED APPLICATIONS

This application claims priority under 35 USC 120 of U.S. Provisional Patent Application No. 61/089,935 filed Aug. 19, 2008, entitled "Guitar Body Shape Converter" The entire disclosure of the aforementioned provisional application is incorporated herein by reference in its entirety.

BACKGROUND OF THE INVENTION

Technical Field of the Invention

Stringed instruments such as guitars have been classically constructed as a single unit comprising a neck and a body, with strings being affixed near the back end of the body (the tailpiece) and near the front end of the neck (the headstock). The strings run over a bridge which elevates them off the substantially flat surface of the instrument and allows them to be struck, picked, or strummed for generation of musical notes. The body is an integral part of the instrument.

It is known that some guitars are easier to hold and play then others. U.S. Pat. No. 4,538,497 describes a guitar having a rigid body that includes on a top portion thereof at least a portion that is flexible, so that the top portion of the guitar can conform to the contours of a human body in either of a standing or sitting position, so as to more comfortably be positioned against the body of the player.

U.S. Pat. No. 4,339,981 describes a guitar which is provided with a rigid center portion, which has a soft pillow-like body or cushion surrounding the center portion. The soft cushion avoids uncomfortable localized contact between the body of the musician and parts of the guitar, and it promotes more secure holding by the musician for better performance on the instrument. Also, the cushion is sufficiently flexible so that the stem and neck of the guitar may be suitably positioned for playing by a musician in either standing or sitting position.

U.S. Pat. No. 7,002,065 describes a chassis for a stringed musical instrument such as a guitar, which chassis may be interchangeably connected with any one of a variety of necks resulting in a tunable and playable unit. The chassis may be further attached to any one of a variety of bodies.

Thus, while stringed instruments may have bodies including a portion which is flexible or soft, the soft or flexible body is fixedly attached and permanently part of such instruments. Additionally, although the prior art shows a limited interchangeability of some component parts of a stringed instrument, such as the chassis and string portion, the benefits and means for completely changing the shape of an existing instrument, so as to reconfigure the instrument into a different shape, without changing the musical qualities of the instrument, have not heretofore been realizable nor the benefits recognized. In particular, there is no prior art technique shown for changing the outside shape of an existing guitar, to another shape.

OBJECTS OF THE INVENTION

It is an object of the present invention to allow the player of a stringed instrument having a body of one shape to modify the body shape of that stringed instrument into one which mimics the size, shape, contours and playing feel of a different stringed instrument, such as modifying the shape of solid body (electric style) guitar, to the generally larger, more traditional style hollow body (archtop style) or other shaped guitar. Such modification allows the player to more easily stabilize the body and weight of their stringed instrument without the need of a tight shoulder strap, and while being seated in a relaxed playing position. It can also provide, for example, a novice player's solid body stringed instrument of one shape to be stabilized in a more naturally held playing position so they can concentrate on learning the instrument, and be less concerned with maintaining the instrument in its proper playing position while playing the instrument in a seated position.

SUMMARY OF THE INVENTION

A body adapter for a stringed musical instrument, comprising: a bottom portion, and a varying thickness perimeter sidewall portion, where a space bounded by the bottom portion and an inside portion of the perimeter sidewall portion, forms a receiving compartment. The receiving compartment has a shape adapted to releasably receive the body of a stringed musical instrument and thereby change the shape of the instrument as it is held by a user for playing, from that of the outside shape of the musical instrument, to the outside shape of the body adapter.

Once placed into the receiving compartment of the body adapter, the stringed musical instrument with body adapter can now be held and played in a lap-style manner and stabilized easily within the arm, thigh and abdomen of the player.

DETAILED DESCRIPTION OF THE INVENTION

Figure 1:
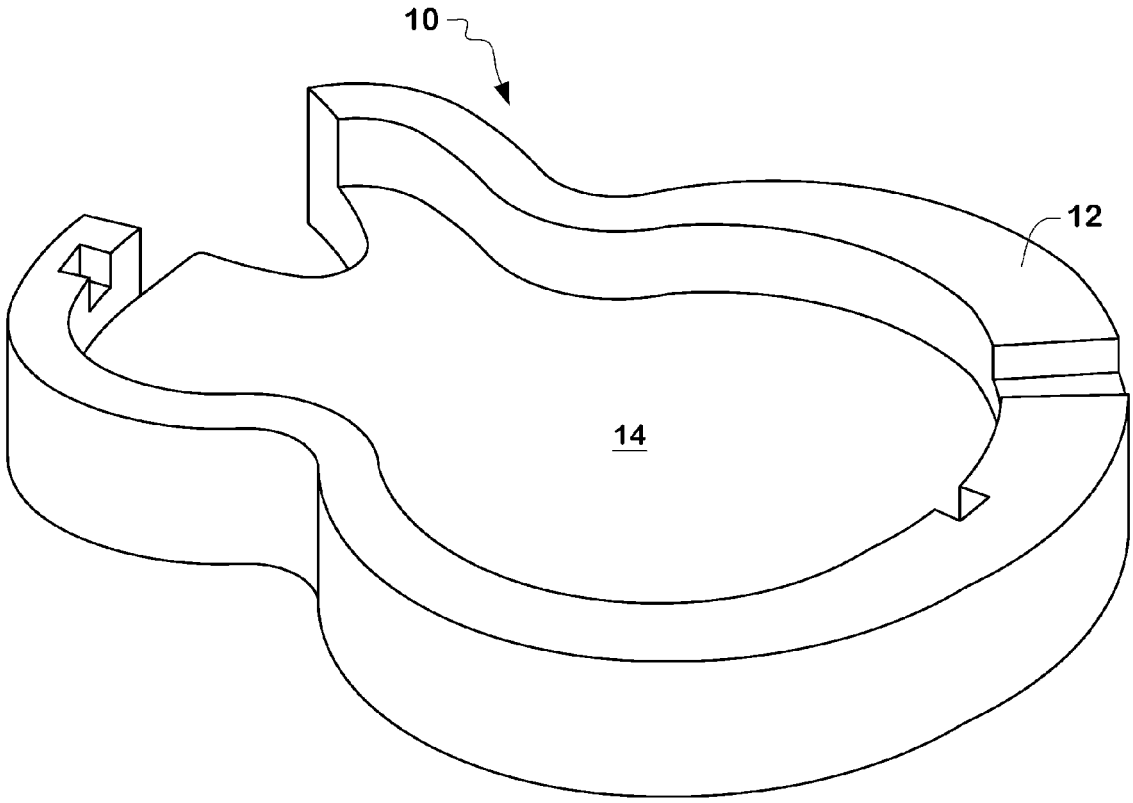
FIG. 1 shows a front perspective view the invention.
Figure 2:
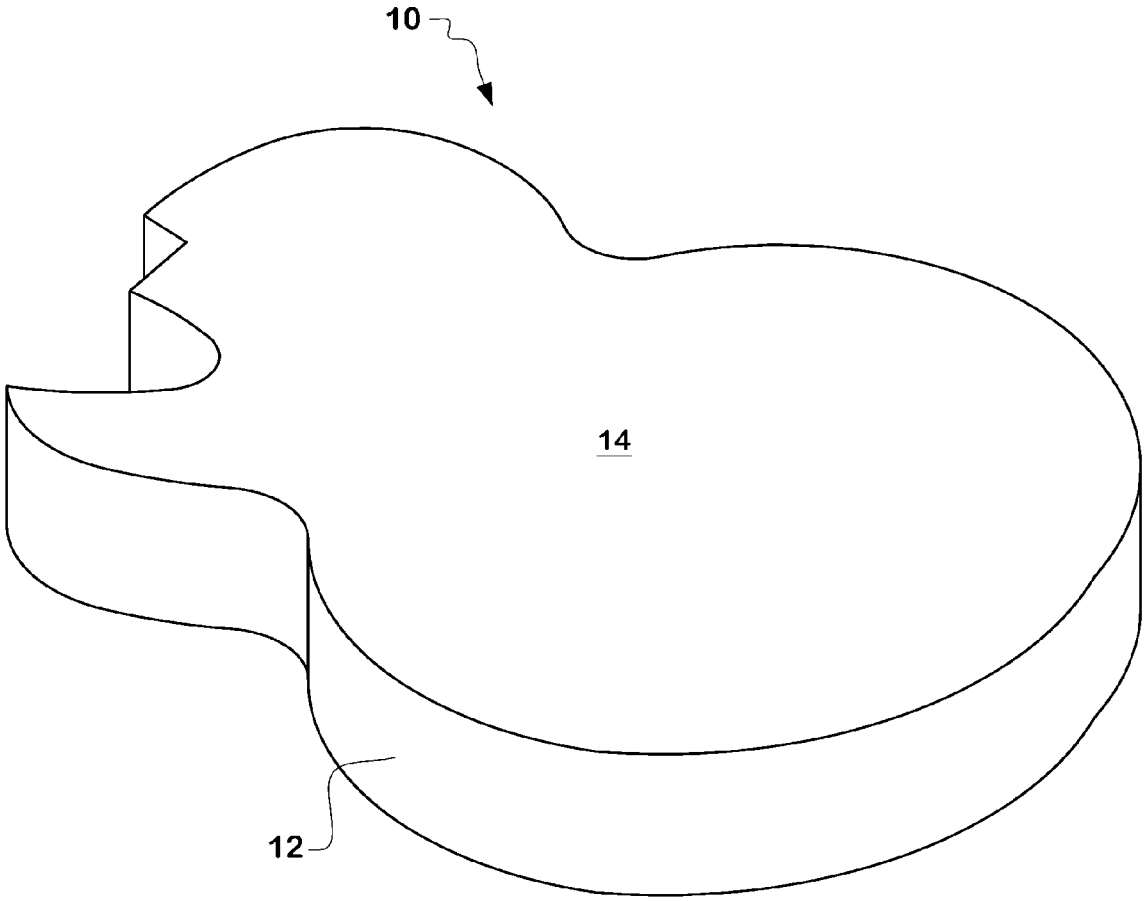
FIG. 2 shows a rear perspective view of the invention.

FIGS. 1 and 2 illustrate one embodiment of the invention, which may be referred to as a "Body Double" 10. The basic body double 10 is comprised of a one-piece molded surround structure, created by an outer perimeter sidewall portion 12 of varying thickness and a back portion 14. The combination of the outer perimeter sidewall portion 12 and a back portion 14 is the creation of a "receiving compartment" within the inside boundaries of the outer perimeter sidewall portion 12. The receiving compartment can have any desired shape, depending upon the inside perimeter shape of the perimeter sidewall portion 12.

In use, a smaller solid body (electric style) stringed instrument, hereinafter referred to as a guitar (although other types of stringed instruments could be used), of one shape is placed firmly into the open, depressed, receiving compartment of the body double 10. The shape of the perimeter sidewall portion 12 provides the additional surrounding material necessary to make up the difference between the shape of the outside of a smaller guitar body design and the outer dimensions and design of another shape, that other shape being the outside shape of the perimeter sidewall portion 12. In the illustrated embodiment, the outside shape of the perimeter sidewall portion 12 can be that of the generally larger, more traditional style hollow body (archtop style) guitar.

The material used to produce the body double 10 may be a plastic resin (such as expanded polystyrene) molded into one of any predetermined interior and outer perimeter shapes, or other suitable material of hollow or solid construction. Once a guitar is placed into the receiving compartment of the body double 10, the guitar/body double assembly can now be held and played in a lap style manner and stabilized easily within the arm, thigh and abdomen of the player.

Figure 3:
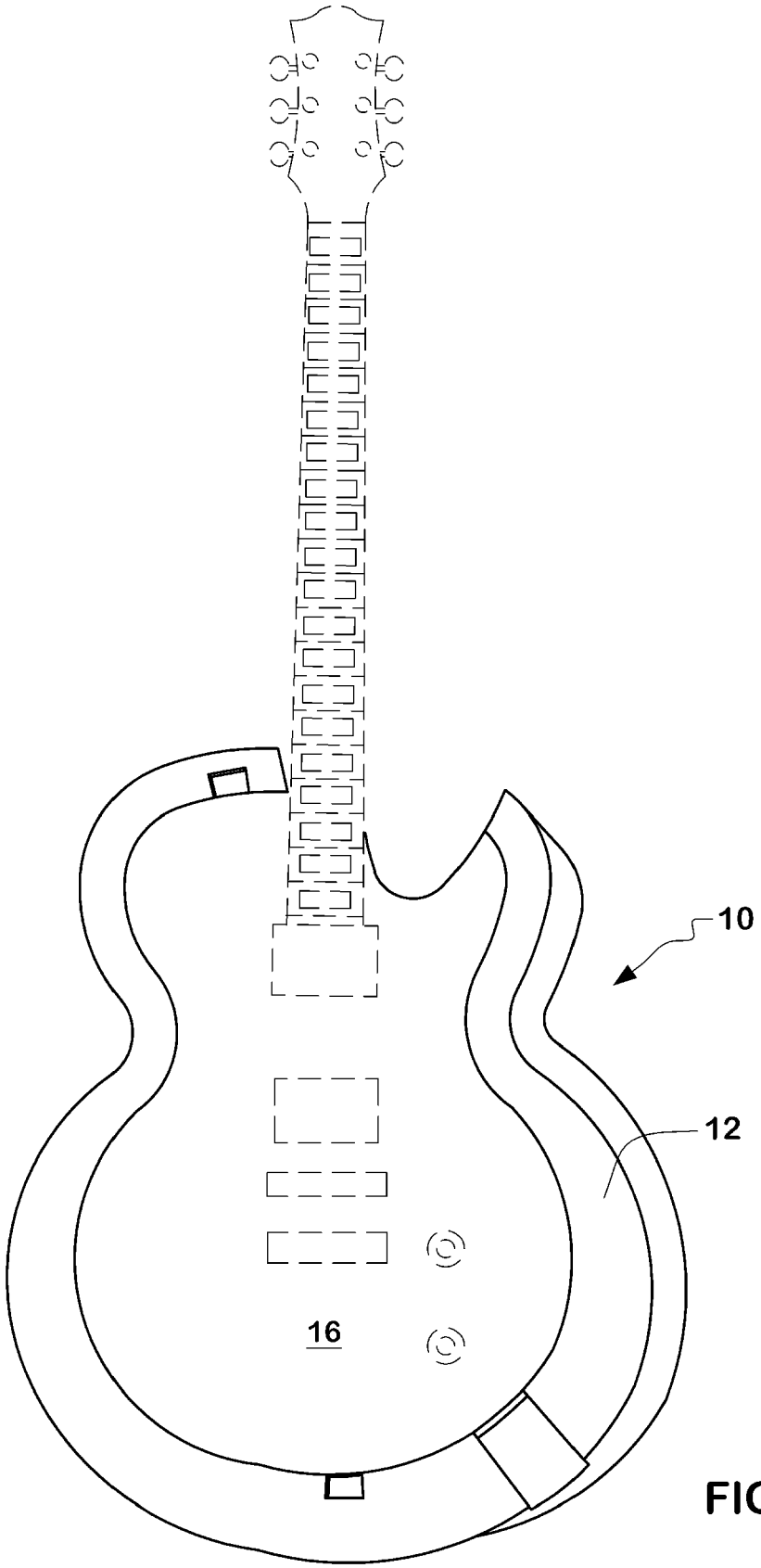
FIG. 3 shows a front perspective view the invention in combination with a guitar, for modifying the shape of the body of the guitar in accordance with the invention.
Figure 4:
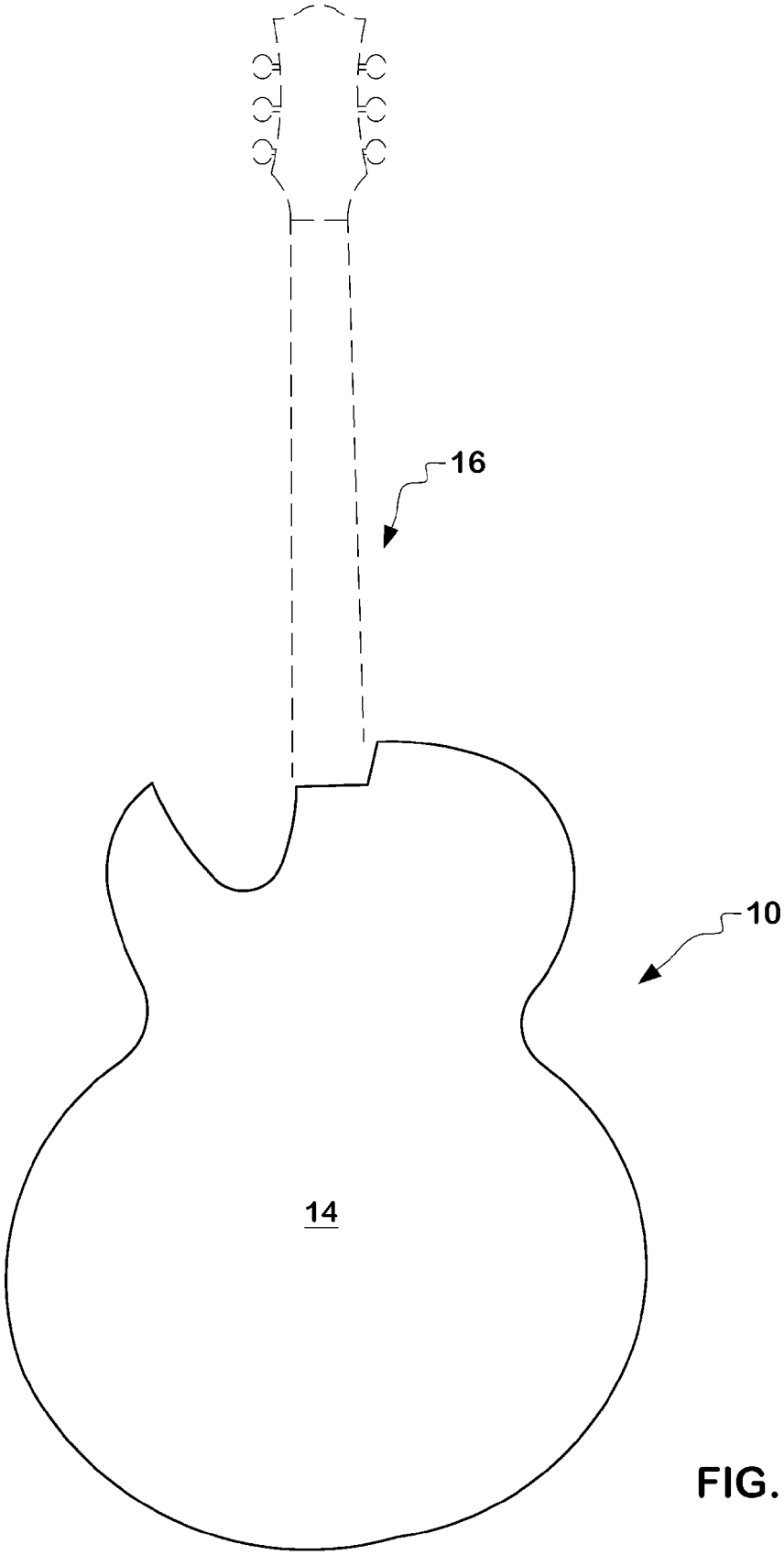
FIG. 4 shows a rear perspective view the invention in combination with a guitar, for modifying the shape of the body of the guitar in accordance with the invention.

FIGS. 3 and 4 show the body double of FIGS. 1 and 2, having an electric guitar 16 inserted therein, so as change the body shape of the playable electric guitar to the size and style of a traditional hollow body (archtop style) guitar.

Figure 5:
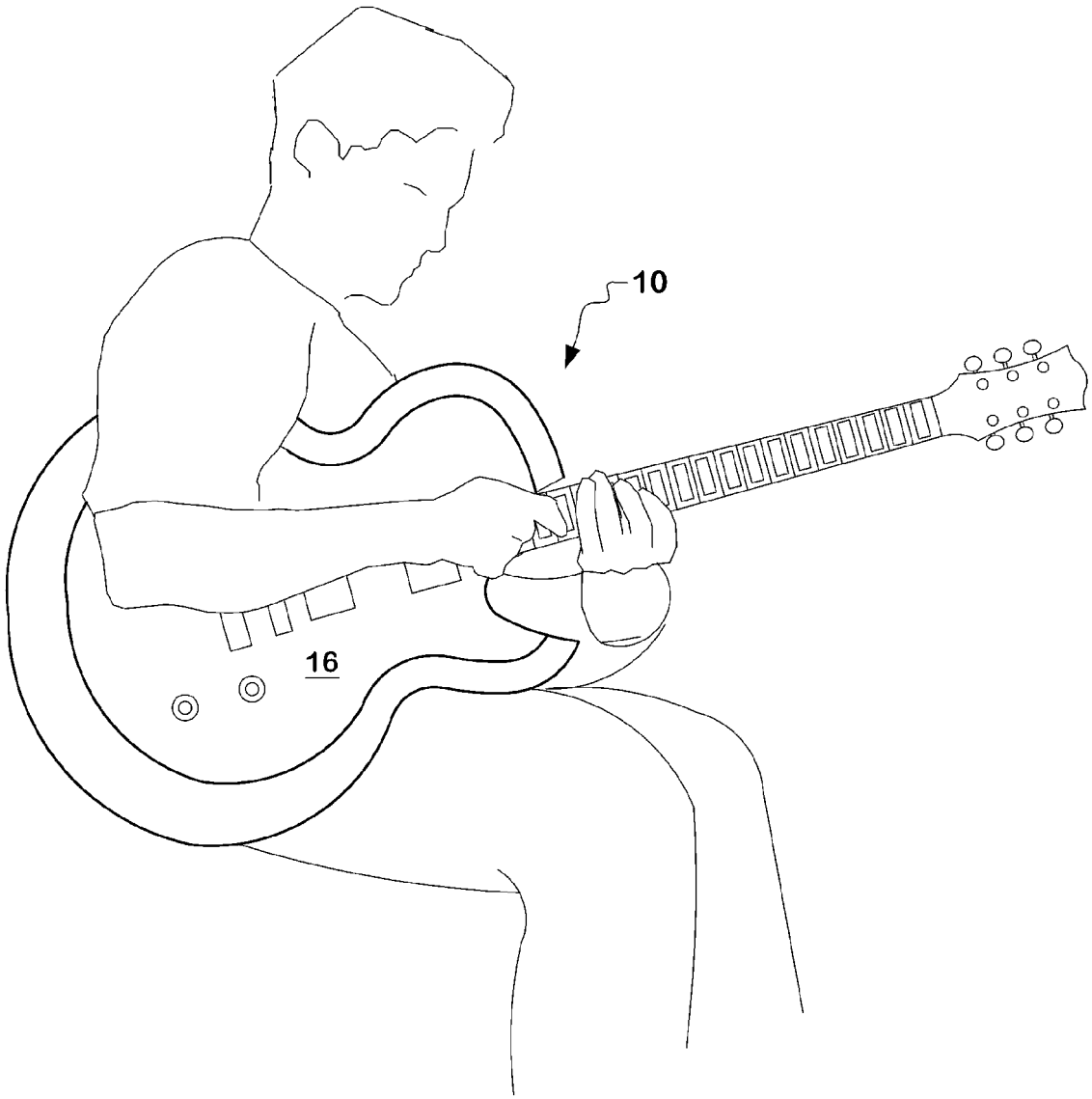
FIG. 5 shows a guitar within the invention in the manner in which it is typically held during use while seated.

FIG. 5 shows the player holding the body double 10 in its intended position with the playable guitar positioned within the receiving compartment. In this way, the smaller playable guitar need not be used with a guitar strap, and it is less likely to slip on the players pant leg. Additionally, the player does not need to hunch over to control the body of the smaller playable guitar.

Figure 6:
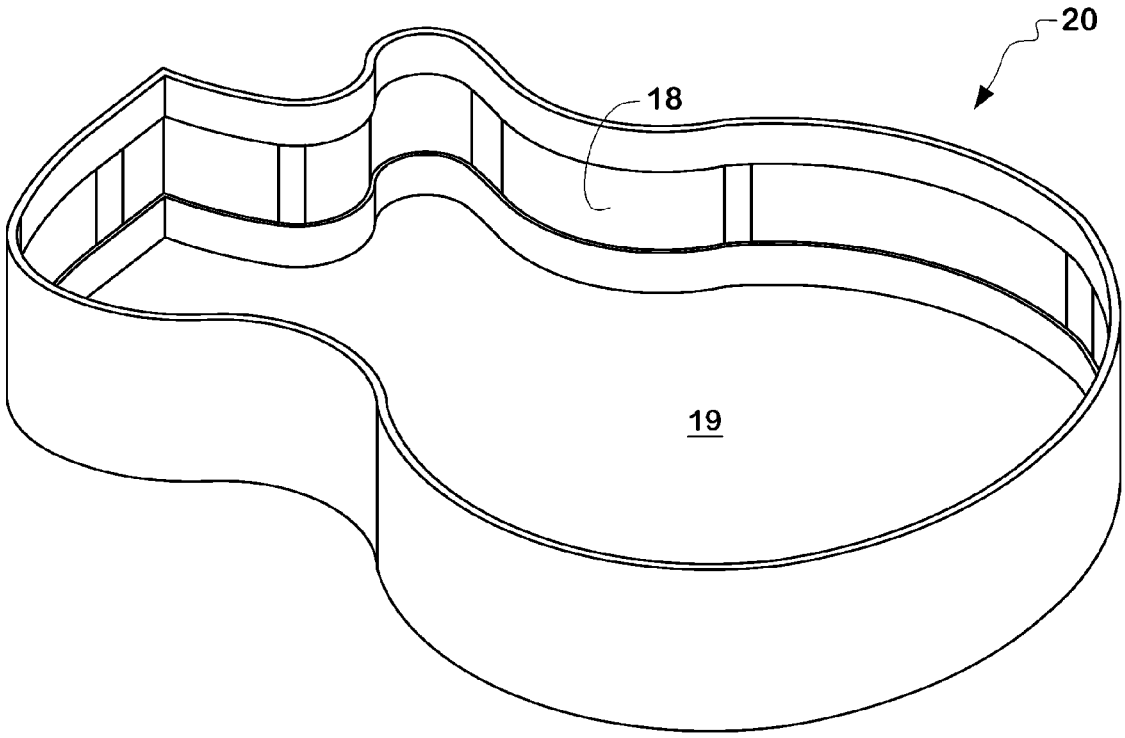
FIG. 6 shows an example of an empty wooden guitar body shell into which, in a more deluxe version, will be adhered to the molded surround structure of the invention.

FIG. 6 shows a deluxe version of the body double 10, where the molded surround structure 10 will be attached within an open-top wooden guitar body shell 20. The wooden guitar body shell 20 will have a back portion 19 and sidewall portion 18 made of wood or laminate and glue, or some other adhesive can be used to join them together, so as to form a somewhat rigid shape, such as the shape of a traditional style hollow body guitar.

Figure 7:
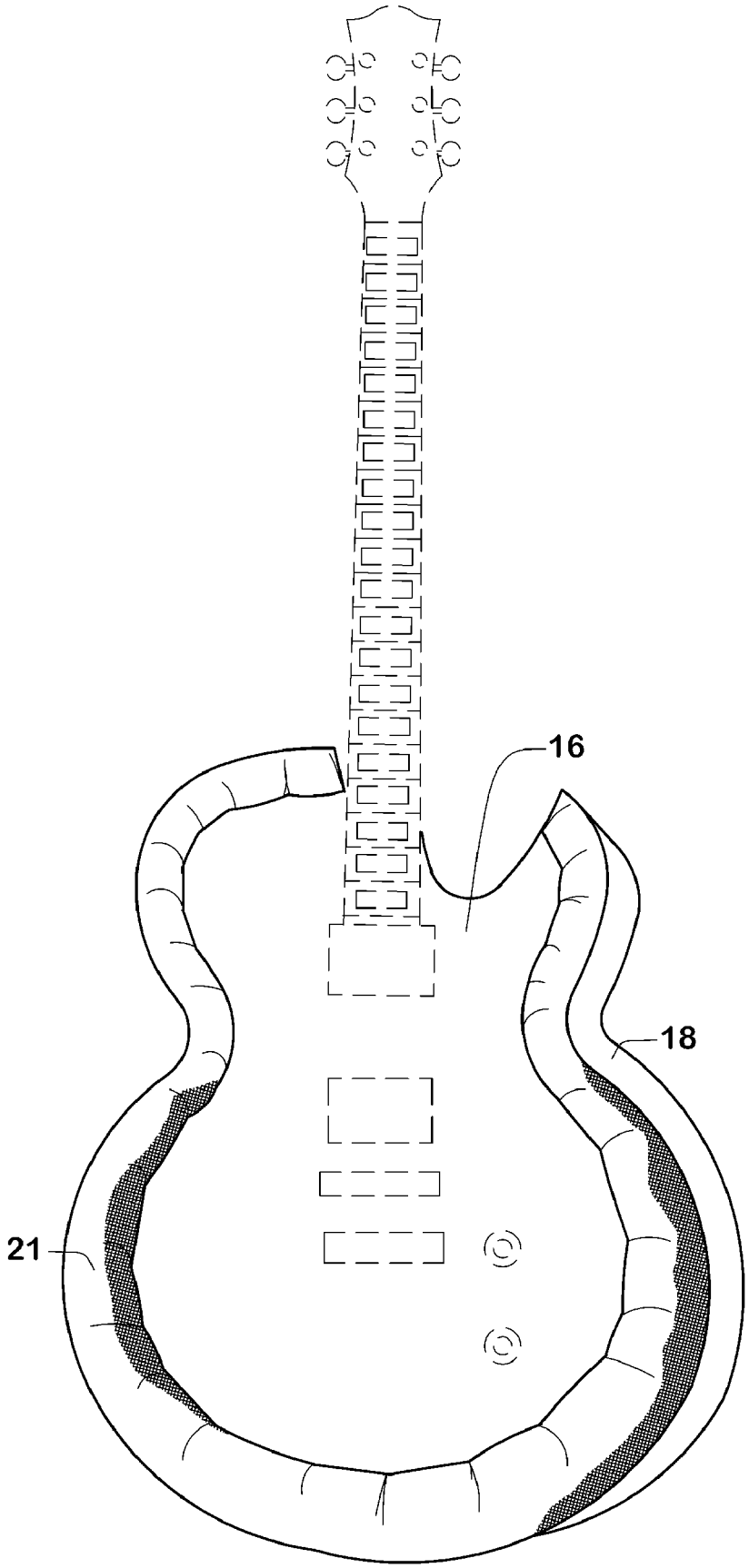
FIG. 7 shows an example of a smaller guitar being surrounded by the encapsulated moldable body within a larger rigid wooden guitar body shell.

FIG. 7 shows an alternate configuration where the perimeter sidewall portion 12 can comprise an encapsulated user-moldable body 21 surrounded by a rigid outer guitar shaped shell, such as the wooden guitar body shell 20 of FIG. 6, which would provide a rigid outer form for the player to hold. The moldable body 21 may comprise a flexible sack (such as found in a child's "bean bag") which contains a material of one type or another capable of adaptively form-fitting itself to the outside profile of a smaller guitar.

Alternatively, body 21 may comprise a molded plastic or otherwise formed semi-rigid shape that is formed so as to generally match a given shape, such as that of a smaller solid body electric guitar.

While this invention has been particularly shown and described with references to preferred embodiments thereof, it will be understood by those skilled in the art that various changes in form and details may be made therein without departing from the sphere and scope of the invention. In fact, some such changes are already noted in this description but it should be realized that the above-noted changes were not exhaustive, and merely exemplary. Those skilled in the art will recognize, or be able to ascertain using no more than routine experimentation, many equivalents to the specific embodiments of the invention described herein. Accordingly, the following claims are intended to embrace all such alternatives, modifications and variations as falling within the spirit and broad scope of the invention.

The invention claimed is:

1. A body shape adapter for converting the shape of the entire body of a stringed musical instrument to a different shape, comprising: a bottom portion, and a varying thickness perimeter sidewall portion, where a space bounded by the bottom portion and an inside portion of the varying thickness perimeter sidewall portion forms a receiving compartment shaped to releasably receive the entire body of a stringed musical instrument, and where an outside portion of the varying thickness perimeter sidewall portion is differently shaped than the inside portion, as a result of said varying thickness, so as to simulate the entire body of a stringed musical instrument of a different shape.

2. The adapter of claim 1, where said adapter is made of a molded plastic material.

3. The adapter of claim 2, where the molded plastic material forms said bottom portion, and where said bottom portion has an outer perimeter whose shape matches an outside shape of the perimeter sidewall portion.

4. The adapter of claim 1, where said perimeter sidewall portion is made of a user-flexible material.

5. The chassis adapter of claim 4, where a rigid sidewall portion is provided so as to surround the said user-flexible material and form a rigid outside shape for the perimeter sidewall portion.

6. A method for converting the shape of the body of a stringed musical instrument from a first shape to a second shape, comprising:

providing an adapter having a receiving compartment for receiving the entire body of a stringed musical instrument, said receiving compartment having an outside shape which is typical of a second type of stringed musical instrument, and an inside shape adapted to receive the body of a stringed musical instrument having an outside shape which is typical of a first type of stringed musical instrument, and placing the entire body of a stringed musical instrument of the first type into said receiving compartment, so as to thereby convert the outside shape of the body of the stringed musical instrument from the first shape to the second shape.

* * * * *